US006554629B2

(12) United States Patent
Koch

(10) Patent No.: US 6,554,629 B2
(45) Date of Patent: Apr. 29, 2003

(54) ELECTRICAL CONNECTOR WITH SWITCH-ACTUATING SLEEVE

(75) Inventor: Richard M. Koch, Wakefield, MA (US)

(73) Assignee: Tru Corporation, Peabody, MA (US)

( * ) Notice: Subject to any disclaimer, the term of this patent is extended or adjusted under 35 U.S.C. 154(b) by 0 days.

(21) Appl. No.: 09/894,414

(22) Filed: Jun. 28, 2001

(65) Prior Publication Data

US 2002/0045371 A1 Apr. 18, 2002

Related U.S. Application Data

(60) Provisional application No. 60/214,580, filed on Jun. 28, 2000.

(51) Int. Cl.[7] ..... H01R 29/00

(52) U.S. Cl. ..... 439/188; 439/289; 200/51.09

(58) Field of Search ..... 439/188, 63, 944, 439/289, 11; 200/51.09, 153

(56) References Cited

U.S. PATENT DOCUMENTS 4,364,625 A * 12/1982 Baker et al. ..... 379/27.08
4,758,696 A * 7/1988 Grazer ..... 200/501
5,321,218 A 6/1994 Vause
5,462,445 A * 10/1995 Anhalt ..... 200/51.1
5,635,690 A 6/1997 Knecht et al.
5,831,229 A 11/1998 Chou
5,836,776 A 11/1998 Koch ..... 439/188
5,885,096 A * 3/1999 Ogren ..... 200/504
5,921,794 A 7/1999 Koch
5,951,313 A * 9/1999 Arimoto ..... 200/51.09
6,053,756 A 4/2000 Flanigan et al.
6,146,168 A * 11/2000 Ishii ..... 439/188
6,152,750 A * 11/2000 Huguenet et al. ..... 200/51.1

FOREIGN PATENT DOCUMENTS

GB 2230657 A1 * 10/1990 ..... 13/62

* cited by examiner

*Primary Examiner*—Tho D. Ta
*Assistant Examiner*—Edwin A. León
(74) *Attorney, Agent, or Firm*—Grossman, Tucker, Perreault & Pfleger, PLLC

(57) ABSTRACT

A receptacle portion of an electrical connector assembly including an axially movable sleeve biased to a default sleeve position. At the default sleeve position, a switch having a switch arm biased against the axially movable sleeve is in an open condition. Upon mating of the receptacle with a mating plug, the sleeve moves axially for moving the switch to a closed position.

9 Claims, 5 Drawing Sheets

ELECTRICAL CONNECTOR WITH SWITCH-ACTUATING SLEEVE

CROSS-REFERENCE TO RELATED APPLICATIONS

The present application claims the benefit of U.S. provisional application No. 60/214,580 filed Jun. 28, 2000, the teachings of which are incorporated herein by reference.

FIELD OF THE INVENTION

This invention relates in general to electrical connectors, and in particular to an electrical connector having a switch-actuating sleeve, which trips a switch upon connection to a mating plug.

BACKGROUND OF THE INVENTION

In high frequency and high power electrical applications, the application of power to associated equipment involves inherent risks that are of concern to both manufacturers and users of such equipment. Power must be applied in a manner that will not result in damage to the equipment, and in a manner that provides a safe environment for users. For example, when high power, e.g., kilowatts, RF signals are transmitted along a cable that is disconnected from a load, i.e., on an open circuit, the energy may be reflected back to the power or signal source, thereby destroying the same. Also, if a conducting material is in close proximity to the end of the cable through which the high power signal is applied, the signal may arc across an air gap to the conducting material. This could cause serious risks of electrical shock, equipment damage, or fire.

Another concern relates to the risk of electrical shock to the users of the high power equipment. When power is applied along a cable that is disconnected from a load, it is possible that a user may come into physical contact with the "hot" end of the cable. This can occur, for example, through inadvertent direct contact with the center conductor of the cable, or by inadvertent contact of a hand tool with the center conductor. Regardless of the manner of contact, however, sufficient power to seriously injure or kill a person if frequently applied to the cable. Prevention of contact with the center conductor of the cable is, therefore, of extreme importance.

To date, users of high-power RF equipment have generally been left to their own resources to limit the risks associated with the application of a high power signal to an open circuit. Most users are highly cognizant of the risks. Human error and accident, however, frequently result in serious injury to users and damage to equipment.

There is, therefore, a need in the art for electrical connectors, particularly connectors for use in high power applications, which are capable of switching an electrical signal source off when the connection between the signal source and the electrical device is removed.

BRIEF SUMMARY OF THE INVENTION

A receptacle portion of a connector assembly consistent with the invention includes an axially movable sleeve biased to a default sleeve position, and a switch having a switch arm biased against the axially movable sleeve for placing said switch in an open position when said axially movable sleeve is in said default sleeve position. Upon mating of the receptacle with a mating plug, the sleeve moves axially for moving the switch to a closed position.

BRIEF DESCRIPTION OF THE DRAWINGS

For a better understanding of the present invention, together with other objects, features and advantages, reference should be made to the following detailed description which should be read in conjunction with the following figures wherein like numerals represent like parts.

DETAILED DESCRIPTION

An exemplary connector assembly consistent with the present invention may be adapted for mounting to a fixed location, e.g. an instrument panel or the like, for making a removable electrical connection between an electrical signal source and an electrical device. Those skilled in the art will recognize, however, that the advantages of the present invention could also be incorporated in many other connector designs. It is intended therefore, that the present invention not be limited to any specific exemplary embodiment described. Advantageously, a connector consistent with the present invention includes an axially movable sleeve in a receptacle, which activates and deactivates a switch for controlling the flow of current through the connector in dependence on whether a mating plug is properly secured to the receptacle.

Figure 1:
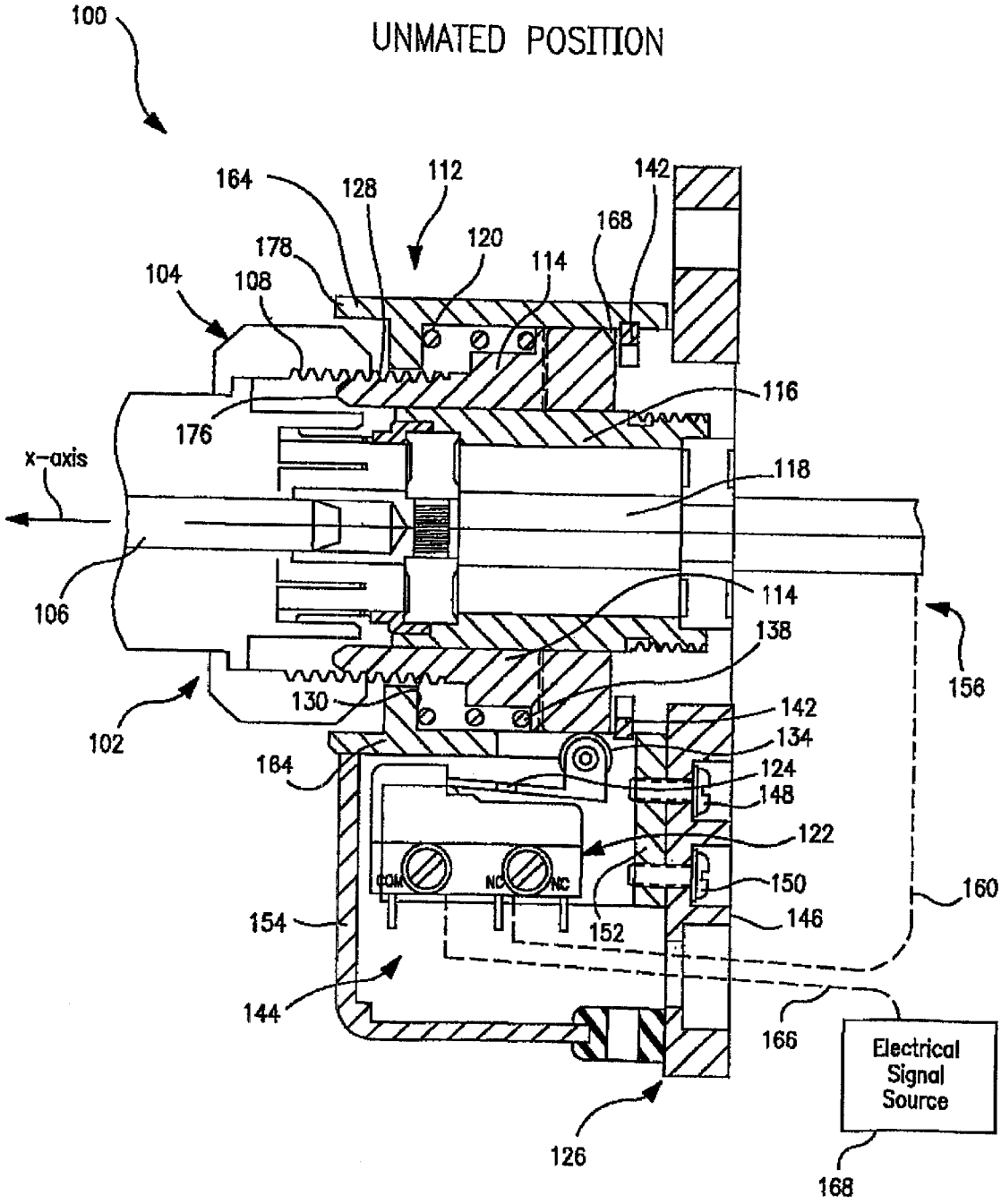
FIG. 1 is a side sectional view of an exemplary embodiment of a connector assembly consistent with the present invention in an unmated position.

Turning to FIG. 1, a side sectional view of an exemplary embodiment of a connector assembly 100 consistent with the present invention is illustrated. The connector assembly 100 is illustrated in an unmated position. For convenience in comparison to an exemplary connector in a mated position 300 (FIG. 3), the plug portion 102 of the connector assembly is illustrated. Of course those skilled in the art will recognize that the plug 102 does not, and typically will not, be present in the unmated position. The plug 102 may include an outer shell 104 and a plug center conductor 106. The outer shell 104 may further include a threaded portion 108.

The receptacle portion 112 of the connector assembly 100 may include an axially movable sleeve 114, a compression spring 120, an insulator 116, a receptacle center conductor 118, a switch 122, a shroud 164, and a mounting plate 126. The axially movable sleeve 114 may be further provided with a threaded portion 128 to meshingly engage the threaded portion 108 of the outer shell 104 of the plug portion assembly 102. Those skilled in the art will recognize that other methods of engaging the plug portion assembly, e.g., magnetically, may also be utilized without departing from the scope of the present invention.

The switch 122 may further include a switch lever arm 124 and a roller 134 disposed on the end of the arm to activate different positions of the switch 122. The switch 122 may further be disposed in a switch housing 154 that forms a cavity 144 about the switch. The switch 122 may further be secured to the mounting plate 126 by a support bracket 152 and associated mounting screws 146, 148. The mounting plate 126 facilitates mounting of the receptacle portion 112 to a fixed location, e.g., an instrument panel. Those skilled in the art will recognize a variety of switch mounting and enclosure configurations that may be utilized without departing from the scope of the present invention.

At one end 156 of the receptacle portion 112, the receptacle center conductor 118 is positioned axially outward along the x-axis from the bottom surface 146 of the mounting plate 126. This facilitates the formation of an electrical connection between an electrical conductor 160 and the receptacle center conductor 118, e.g. by soldering. At the opposite end of the receptacle portion, the receptacle center conductor 118 may be positioned axially inward relative to the outer annular ring surface 178 of the shroud 164, and relative to outer annular ring surface 176 of the axially movable sleeve 114.

The compression spring 120 may be disposed between a radially inward projecting flange 130 on the shroud 164 and a second shelf portion 138 of the axially movable sleeve 114. Advantageously, the compression spring 120 biases the axially movable sleeve 114 toward the mounting plate 126 until the sleeve encounters and abuts the stopper 142 in the unmated or default position illustrated in FIG. 1. The stopper 142 and the shroud 164 may be formed of two separate pieces, which are secured together, e.g. by brazing. It is also possible, however, to form the shroud 164 and stopper 142 as a single piece.

In operation, a plug portion 102 may be removed from the receptacle portion 112 by unscrewing the threaded portion 108 of the outer shell 104 to disengage the threaded portion 128 of the axially movable sleeve 114. The compression spring 120 may then be free to bias the axially movable sleeve up against the stopper 142. In doing so, an outer edge portion 212 (FIG. 2) of the axially movable sleeve 114 may depress the switch roller 134 downward. This, in turn, depresses the switch lever arm 124 downward. When the switch lever arm 124 is in this default position, the switch is maintained in a normally open position.

Figure 1A:
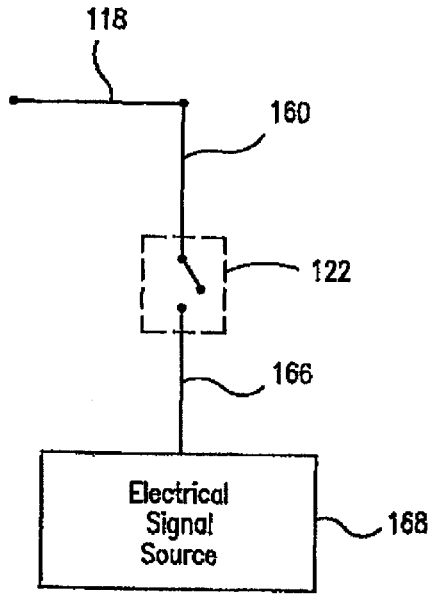
FIG. 1A is a simplified electrical one-line diagram illustrating the electrical connections of the exemplary connector assembly of FIG. 1 in the unmated position.

Turning to FIG. 1A, a simplified electrical one-line diagram illustrating the electrical connections of the exemplary connector assembly of FIG. 1 in the unmated position is illustrated. When the switch lever arm 124 is in the depressed or default position, the switch 122 is open. This effectively isolates the electrical signal source 168 from the receptacle center conductor 118. As such, the end of the receptacle center conductor 118 is never "hot" when it is properly disconnected from a mating plug portion 102. The risks of personal injury or damage to equipment resulting from inadvertent contact with the end of the receptacle center conductor 118, or from arcing of an electrical signal from the center conductor, are, therefore eliminated.

Figure 2:
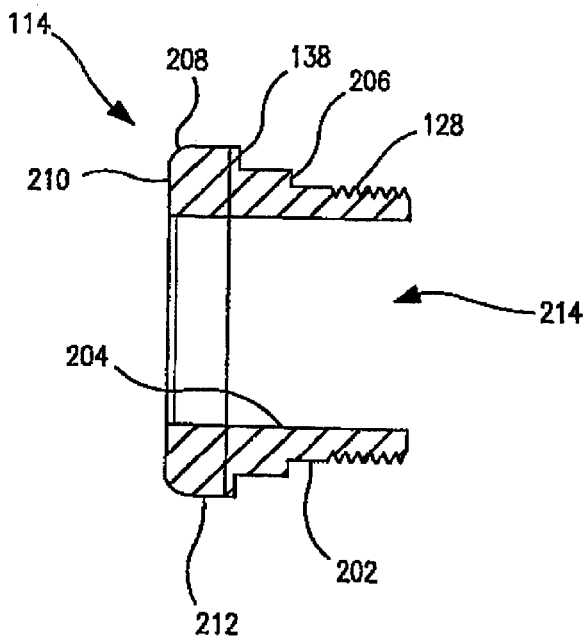
FIG. 2 is a side sectional view of an exemplary axially movable sleeve consistent with the present invention.

Turning now to FIG. 2, a side sectional view of an exemplary movable axial sleeve 114 consistent with the present invention is illustrated. The exemplary axially movable sleeve 114 may be generally cylindrical in shape with a stepped outer surface 202 and a flat inner surface 204. The outer edges of the surfaces provide an axial opening 214 large enough to accept the receptacle center conductor 118. The flat inner surface 204 mates up against the insulator sleeve 116 and is permitted to translate axially.

Figure 3:
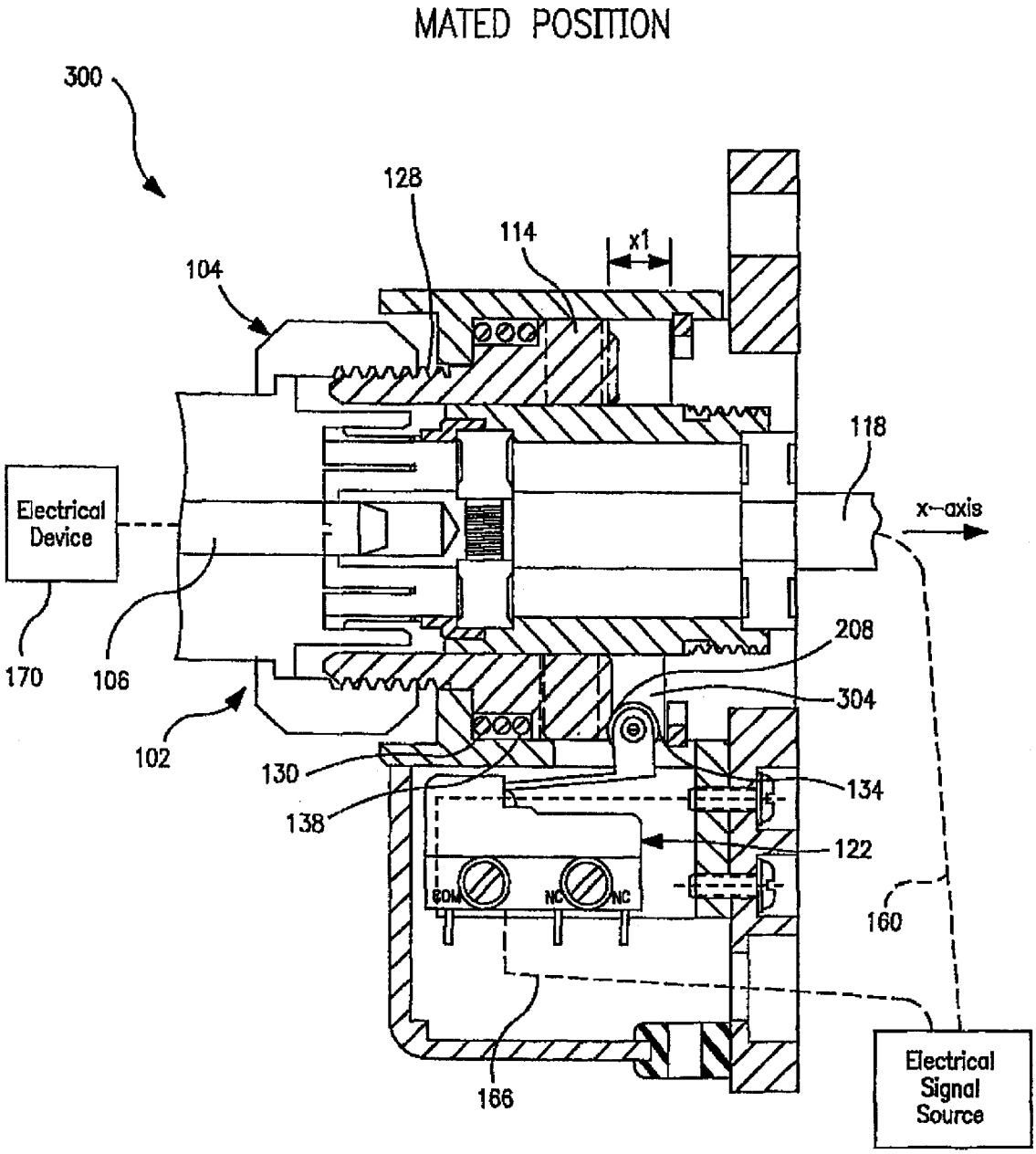
FIG. 3 is a side sectional view of an exemplary embodiment of a connector assembly consistent with the present invention in a mated position.

The stepped outer surface 202 may include a first shelf portion 206 that contacts the radially inward projecting flange 130 to stop axial movement of the sleeve 114 when a plug portion 112 is fully threaded to the receptacle (FIG. 3). The stepped outer surface 202 may also include a second shelf portion 138 for supporting one end of the compression spring 120 disposed between it and the radially inward projecting flange 130.

The stepped outer surface 202 may also include a beveled edge 208. Advantageously, the beveled edge 208 creates a triangular air gap 168 in the corner between the stopper 142 and the shroud 164 in the unmated position (FIG. 1). This helps the axially movable sleeve 114 to translate more freely against the shroud 164, and helps alleviate unwanted sticking of the axially movable sleeve up against the stopper 142 in the unmated position. The beveled edge 208 also helps to more smoothly move the roller 134 disposed on the switch lever arm as more fully described in reference to FIG. 3.

In comparison to the unmated configuration of FIG. 1, FIG. 3 illustrates a side sectional view of an exemplary embodiment 300 of a connector assembly consistent with the present invention in the mated position. The exemplary assembly 300 utilizes the exemplary movable axial sleeve 114 illustrated in FIG. 2. For clarity sake, most reference numerals for various components that have been introduced already in conjunction with FIG. 1 have been omitted in FIG. 3.

In the mated position of FIG. 3, the plug portion 102 is drawn towards the receptacle portion 112 by the meshing engagement of mating threads 108, 128. As such, the axially movable sleeve may be drawn a distance x1 away from the mounting plate 126 against the bias of the spring 120. The spring 120 is thus compressed between the second shelf portion 138 of the outer surface 402 of the axially movable sleeve 114 and the radially inward projecting flange 130.

The movement of the axial movable sleeve 114 away from the mounting plate 126 leaves an open cavity 304 to accept the upwardly biased roller 134 disposed on the end of the switch lever arm 124. The beveled edge 208 of the axially movable sleeve 114 permits a more reliable motion of the switch lever arm because the roller 134 may more smoothly roll into and out of the open cavity 304 over the beveled edge surface.

Figure 3A:
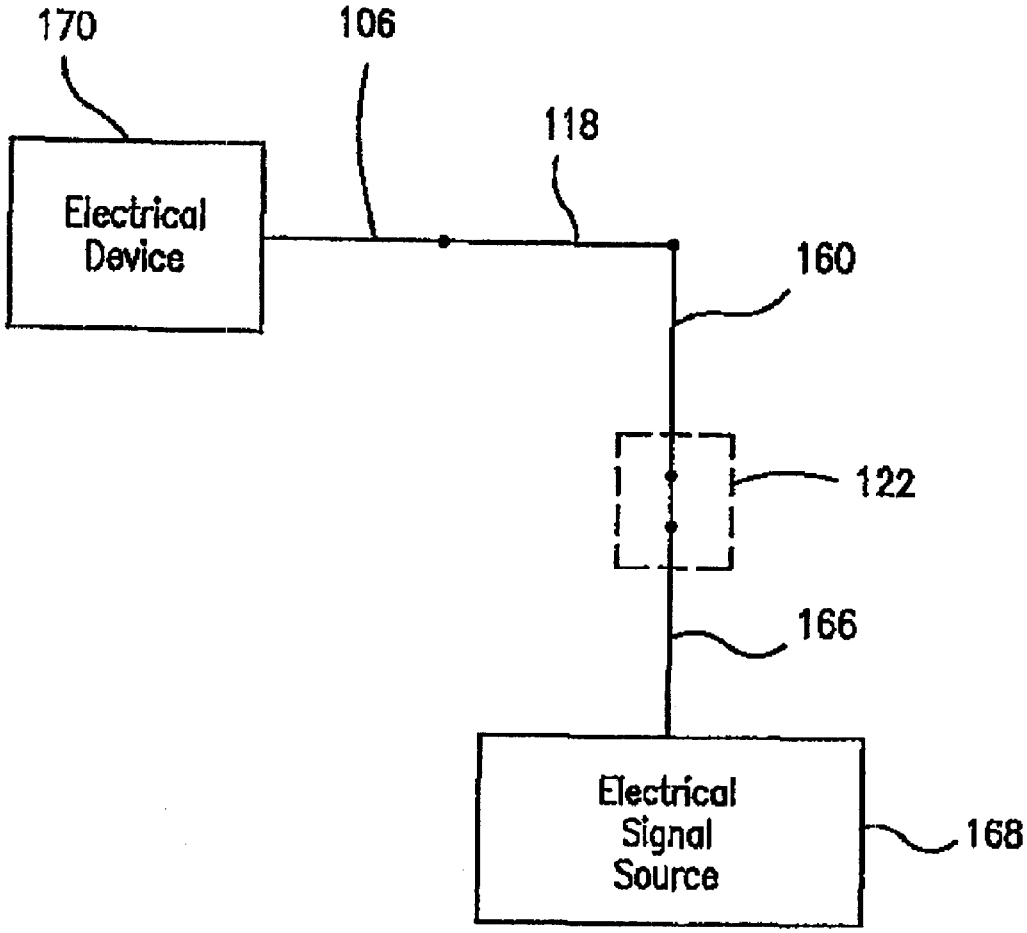
FIG. 3A is a simplified electrical one-line diagram illustrating the electrical connections of the exemplary connector assembly of FIG. 1 in the mated position.

When the switch lever arm 124 is in the upward position as illustrated in FIG. 3, the switch 122 may be advantageously in the closed position. A simplified electrical one-line diagram illustrating the electrical connections of the exemplary connector assembly in the mated position is illustrated in FIG. 3A. Again, when the switch lever arm is in the upward position, the switch 122 may be closed. Thus, the electrical signal source 168 may be electrically connected through the switch 122, conductors 160, the receptacle center conductor 118, and the plug center conductor 106, to provide the desired power to the electrical device 170. Advantageously, therefore, current from the electrical signal source 168 may be supplied through the connector assembly 300 only when the plug 102 is fully threaded onto the receptacle. The dangers of inadvertent shock or damage to equipment associated with providing an open connection to a power source are, therefore, eliminated.

Figure 4:
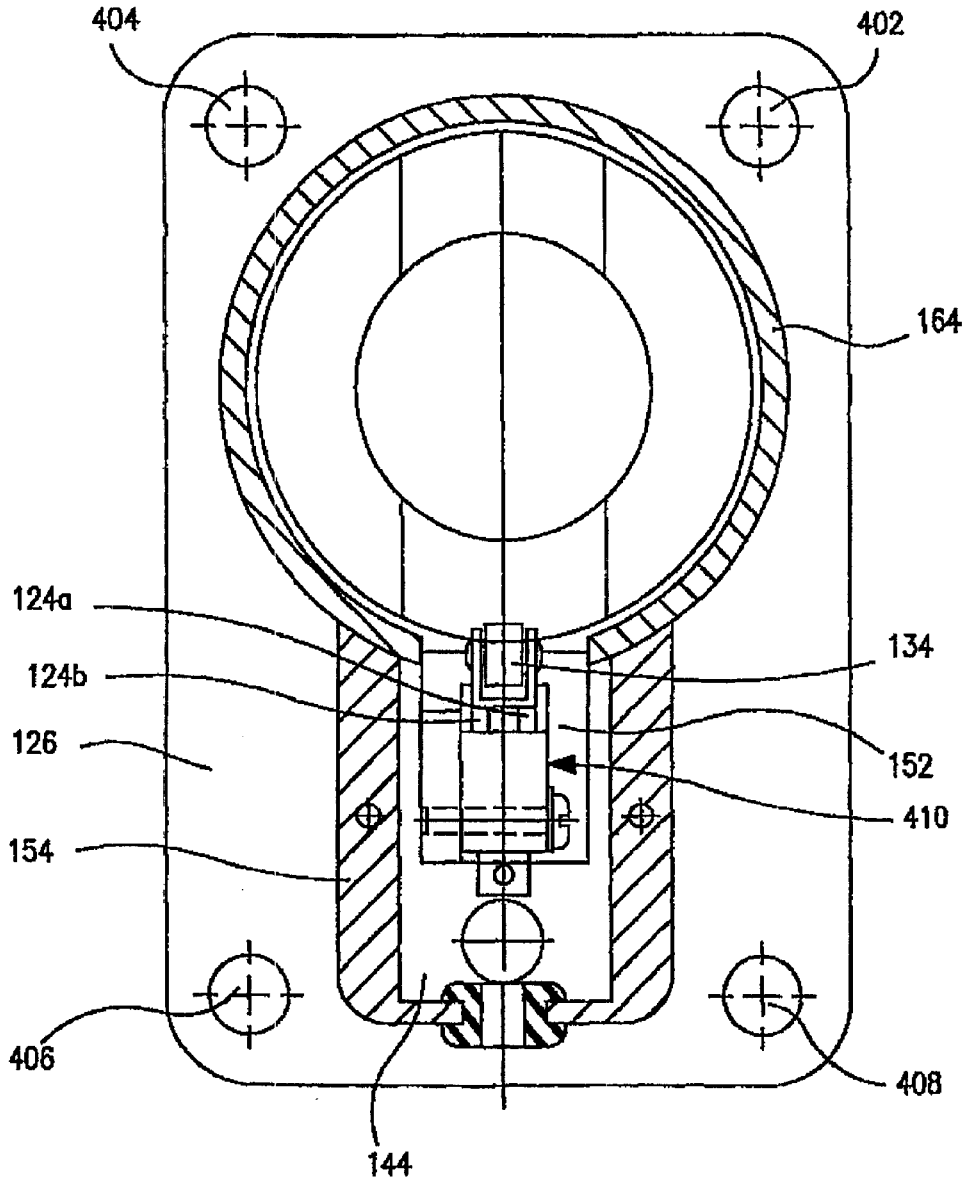
FIG. 4 is an end, partial sectional view of the exemplary connector assembly illustrated in FIG. 3.

Turning to FIG. 4, an end partial sectional view along the line A—A of FIG. 3 for the exemplary mated connector assembly 300 is illustrated. This view illustrates one exemplary subminiature, snap-action, single pole, double throw switch 410 having a roller 134 disposed on its end. Hence, the double pole switch may be equipped with two switch lever arms 124*a*, 124*b* coupled to the roller 134. The exemplary switch may be further equipped with a spring (not shown) to bias the switch lever arms upward, and may be mounted to an L-shaped support bracket 152. Those skilled in the art will recognize a variety of switches and support bracket configurations that may be utilized in a connector assembly consistent with the present invention.

The bottom surface 146 of the mounting plate 126 may be secured to a fixed position, e.g. on the outer surface of an instrument panel, by installing screws through screw holes 402, 404, 406, 408 in the mounting plate 126 into the fixed position surface. To protect the switch 410, the switch housing 154 may be slightly thicker than the shroud 164 that surrounds the receptacle portion.

There is thus provided an electrical connector, which eliminates the hazards of providing a high power electrical signal to an unmated receptacle. The receptacle includes an axially movable sleeve for causing associated movement of a switch lever arm. Upon mating of a plug with a receptacle, the sleeve is caused to travel axially within the receptacle portion of the connector towards the plug. This leaves an open cavity for an upwardly biased roller disposed on a switch lever arm to ascend upward. This position of the switch lever arm for the mated position closes a normally open switch and establishes an electrical connection between an electrical signal source and the receptacle center conductor. When the mating plug is removed, the sleeve withdraws into the receptacle and the connector switch is returned to the "open" state.

The embodiments that have been described herein, however, are but some of the several which utilize this invention and are set forth here by way of illustration but not of limitation. It is obvious that many other embodiments, which will be readily apparent to those skilled in the art, may be made without departing materially from the spirit and scope of the invention.

What is claimed is:

1. An receptacle portion of a connector assembly comprising:

a receptacle center conductor, a mating end adapted to removably receive a mating plug for creating an electrical connection between said receptacle center conductor and a mating plug center conductor, an axially movable sleeve biased to a default sleeve position, said axially movable sleeve having threads thereon for meshingly engaging corresponding threads on said mating plug; and a switch having a switch arm biased against said axially movable sleeve for placing said switch in an open position when said axially movable sleeve is in said default sleeve position, wherein upon threaded engagement of said axially movable sleeve and said mating plug, said sleeve is adapted to move axially thereby placing said switch in a closed condition.

2. The receptacle of claim 1, wherein said switch is a single pole, double-throw switch.

3. The receptacle of claim 1, wherein said axially movable sleeve has a beveled edge.

4. The receptacle of claim 1, wherein said axially movable sleeve is biased to said default sleeve position by a compression spring disposed between said axially movable sleeve and a shroud.

5. The receptacle of claim 4, wherein said compression spring is disposed between a shelf on said axially movable sleeve and said shroud.

6. The receptacle of claim 4, wherein said axially movable sleeve abuts a stopper on said shroud in said default sleeve position.

7. The receptacle of claim 1, wherein said switch arm comprises a switch roller, and wherein said switch roller is biased against said sleeve.

8. The receptacle of claim 7, wherein an insulator together with said axially movable sleeve at least partially define a cavity to accept said switch roller upon mating of said first end of said receptacle with said mating plug.

9. The receptacle of claim 1, wherein said axially movable sleeve has threads thereon for meshingly engaging corresponding threads on said mating plug, and wherein upon threaded engagement of said axially movable sleeve and said mating plug, said sleeve is adapted to move axially thereby placing said switch in said closed position.

* * * * *

UNITED STATES PATENT AND TRADEMARK OFFICE

CERTIFICATE OF CORRECTION

PATENT NO. : 6,554,629 B2
DATED : April 29, 2003
INVENTOR(S) : Richard M. Koch

It is certified that error appears in the above-identified patent and that said Letters Patent is hereby corrected as shown below:

Column 6,
Line 33, replace "The receptacle of claim 1" with
-- A receptacle portion of a connector assembly comprising:
an axially movable sleeve biased to a default sleeve postion; and
a switch having a closed position wherein an electrical current path is provided through said switch and an open position wherein said electrical current path is electrically open, said switch having a switch arm biased against said axially movable sleeve for placing said switch in said open position when said axially movable sleeve is in said default sleeve position --

Signed and Sealed this

Ninth Day of September, 2003

JAMES E. ROGAN
*Director of the United States Patent and Trademark Office*